United States Patent [19]

Kuo

[11] Patent Number: 4,966,478

[45] Date of Patent: Oct. 30, 1990

[54] MECHANICALLY CONTROLLED-WRITING APPARATUS WITH PRESHARPENED PENCIL LEAD ELEMENTS

[76] Inventor: Chun-Liang Kuo, 1st Fl., No. 17, Alley 23, Lane 2, Chung Shan N. Rd., Sec. 6, Taipei, Taiwan

[21] Appl. No.: 393,807

[22] Filed: Aug. 14, 1989

[51] Int. Cl.[5] ..... B43K 21/16

[52] U.S. Cl. ..... 401/57; 401/94; 401/65; 401/84; 401/90

[58] Field of Search ..... 401/57, 62, 65, 90, 401/84, 67, 81–84, 89, 90, 91, 92, 94, 85

[56] References Cited

U.S. PATENT DOCUMENTS

| | | | |
|---|---|---|---|
| 480,188 | 8/1892 | Fornander | 401/57 |
| 618,172 | 1/1899 | Goldsmith | 401/57 |
| 692,440 | 2/1902 | Goldsmith | 401/57 |
| 1,062,274 | 5/1913 | Fischer | 401/84 |
| 1,378,174 | 5/1921 | Kaiser | 401/57 |
| 4,219,282 | 8/1980 | Kuo | 401/57 |
| 4,320,982 | 3/1982 | Kuo | 401/90 |
| 4,657,421 | 4/1987 | Lin | 401/57 |

*Primary Examiner*—Richard J. Johnson

*Attorney, Agent, or Firm*—Asian Pacific Int'l Patent and Trademark Office

[57] ABSTRACT

A mechanically controlled writing apparatus with presharpened pencil lead elements generally comprises of an inner cylinder and a pen-holder. The inner cylinder is a straight hollow tube, having two elongated piercing grooves vertically made at the bottom to permit the bottom end be slightly expanded for passing therethrough of pencil lead elements, and a plurality of wedge-like projections made on the outer wall surface at the bottom end and respectively reducing upward, which wedge-like projections may be squeezed inward by the inner wall surface of the outer pen-holder to firmly retain the bottom pencil lead element for smooth writing. The pen-holder comprises a reduced bottom end having a hook means integrally made thereon to alternatively insert through the two elongated piercing grooves into the inner cylinder, which hook means may be controlled to displace outward through a lever motion effect. When inner cylinder is pressed down, the hook means is pushed aside to further insert through the top surface of the bottom piece of pencil lead element so as to let the bottom piece of pencil lead element protrude beyond the pencil lead outlet for writing when the inner cylinder is pushed upward to original position.

5 Claims, 8 Drawing Sheets

MECHANICALLY CONTROLLED-WRITING APPARATUS WITH PRESHARPENED PENCIL LEAD ELEMENTS

BACKGROUND OF THE INVENTION

The present invention is related to a writing apparatus and more particularly to a mechanically controlled and non-sharpening writing apparatus.

Conventional mechanical and non-sharpening pencils are normally complicated in structure and comprised of four or more component parts, which are relatively expensive to manufacture and very difficult to assemble. There are other kinds of simple mechanically controlled non-sharpening pencils available in on the market. However, the nib of the pencil lead of these simple mechanically controlled non-sharpening pencils is very difficult to control for smooth writing. In case any of the writing elements is missing, the whole assembly becomes unworkable and useless. Further, for replacement of writing elements, they must be refilled from the top end of the pen-holder by means of hand operation. However, the writing elements tend to drop out of the writing apparatus and the hands tend to be contaminated during the filling operation.

SUMMARY OF THE INVENTION

The present invention provides a solution to the above-said problems and provides such a writing apparatus which is applicable for mass production, easy to assemble, simple in structure, inexpensive to manufacture, and practical and durable in use.

It is therefore, the main object of the present invention to provide such a writing apparatus which is comprised of an inner cylinder received in an outer pen-holder wherein the pen-holder includes a retainer portion to retain the transversely projecting top end of the inner cylinder, which retainer portion comprises a top cap disposed to cover over the pencil lead filling inlet of the inner cylinder, and wherein the outer pen-holder comprises a hook means at the lower end to elastically displace inward or outward so as to efficiently control the feeding of a pencil lead element.

It is another object of the present invention to provide such a writing apparatus wherein the inner cylinder has a plurality of wedge-like projections made thereon at the bottom end, which wedge-like projections may be squeezed inward, by the inner wall of the outer pen-holder, to firmly retain the bottom piece of pencil lead element for smooth writing.

It is a further object of the present invention to provide such a writing apparatus which is simply comprised of an inner cylinder, an outer pen-holder, and one or more writing elements (pencil lead elements), and which is characterized in that any missing of one writing element does not interfere with the writing function of the apparatus.

It is still a further object of the present invention to provide such a writing apparatus wherein a pencil lead reservoir is provided for simple filling of pencil lead elements into the inner cylinder so that the precision requirement on the matching between the inner diameter of the inner cylinder and the outer diameter of the writing elements or pencil lead elements becomes not so critical and the manufacturing process becomes more simple.

According to the present invention, the same numerals designated in different drawings represent the same or related portions or parts.

The writing apparatus according to the present invention is not limited to a pencil, which may include any apparatus that uses a nib or point for writing, such as ball-point pen, a crayon, a refill type writing pen or the like. Therefore, the pencil lead element, as described in the detailed description of the present invention, may indicate any writing element which serves as a media for writing.

BRIEF DESCRIPTION OF THE DRAWINGS

Further objects and advantages of the invention will be apparent from a reading of the following detailed description, taken in conjunction with the figures of the accompanying drawings, in which.

DETAILED DESCRIPTION OF THE PREFERRED EMBODIMENTS

Figures 1, 11:
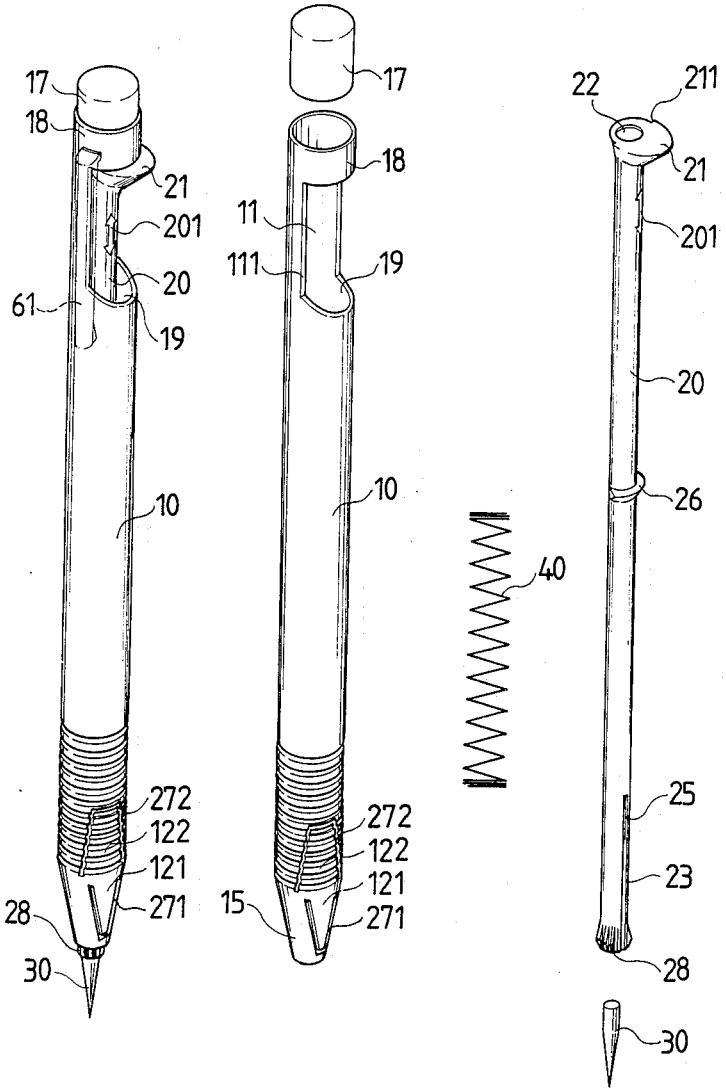
FIG. 1 is a perspective exploded view of a first embodiment constructed according to the present invention.
FIG. 11 is a perspective view of the first embodiment of the present invention, illustrating the outer appearance of the structure.

Referring to FIGS. 1 through 11, there is shown a first embodiment of the present invention which is generally comprised of an outer pen-holder (10) and an inner cylinder (20). The outer pen-holder (10) is a hollow tube having a tapered frusto conical front end (15), and the inner cylinder (20) is received in the outer pen-holder (10) to make reciprocating movement along the central axis of the outer pen-holder (10) by means of manual operation and the effect of a spring (40). An elongated opening is made on the side wall of the outer pen-holder (10) at an upper position to define a neck-like retainer portion (11), through which the inner cylinder (20) may be inserted from the transverse opening (19) into the inner chamber of the outer pen-holder (10) with the bilateral protruding edges (211) of the transversely projecting top end (21) respectively stopped against the two side walls (111) of the retainer portion (11). A cylindrical container portion (18) is integrally made on the top of the outer pen-holder (10) for receiving therein an eraser (17). A semi-circular projection (26) is integrally made on the inner cylinder (20) in the middle part, which has an outer diameter slightly smaller than the inner diameter of the outer pen-holder (10) and serves to stabilize the whole structure of the inner cylinder (20) when the inner cylinder (20) is vertically sliding in the outer pen-holder (10). An index arrow (201) is printed on the inner cylinder (20) at an upper end position for identification of a vertical position change in the outer pen-holder (10). A lower V-shaped slit (271) is made on the reduced front end (15) and an upper V-shaped slit (272) is invertedly made on the reduced front end (15) at the upper side against the lower V-shaped slit (271) to define therewith a suspended elastic hook means (121) and a press portion (122). The elastic hook means (121) is integrally comprising a bottom hook end (13) controlled to move outward by means of the press portion (122) through lever motion.

Figure 2:
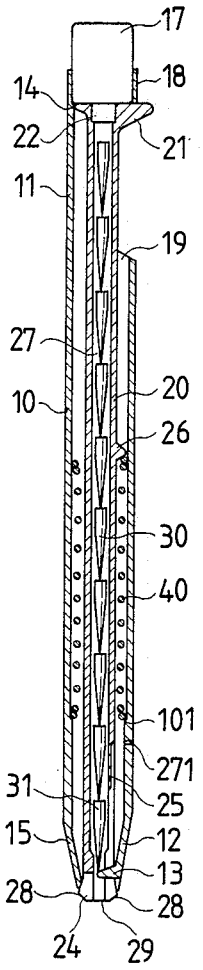
FIG. 2 is an elevated sectional view of the said first embodiment of the present invention, illustrating the pencil lead elements in the inner cylinder stopped by the hook means.
Figure 3:
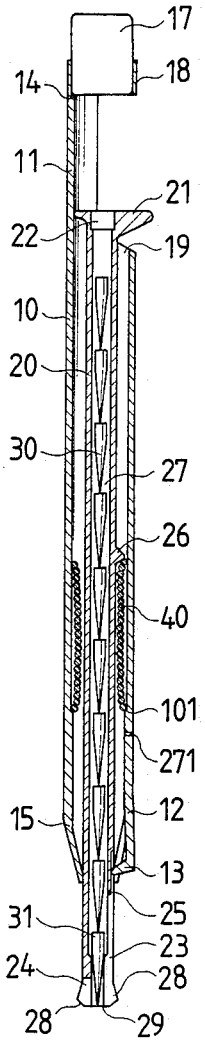
FIG. 3 is a sectional view of the said first embodiment of the present invention, illustrating that the inner cylinder is pressed downward.
Figure 4:
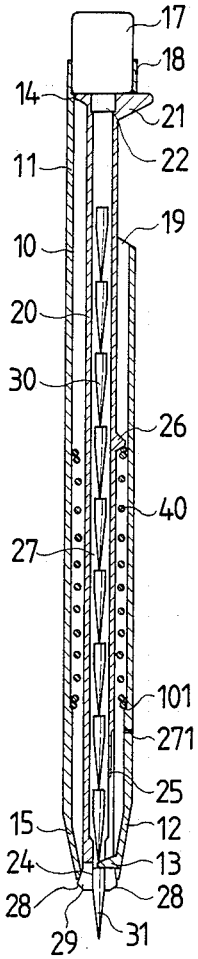
FIG. 4 is an elevated sectional view of the first embodiment of the present invention, illustrating the inner cylinder pushed upward to the original position and a piece of pencil lead element protruding beyond the writing apparatus.

Referring to FIG. 2 through 4, the inner cylinder (20) is shown as a hollow tubular structure comprising an elongated inner chamber (27) for receiving therein a row of pre-sharpened pencil lead elements (30) vertically connected in series. Two elongated grooves (23) and (24) are oppositely pierced through the inner cylinder (20) and vertically extended upward from the pencil lead outlet (29) to provide the lower end of the inner cylinder (20) with an elastic resilience. Therefore, the lower end of the inner cylinder (20) may be elastically clamping inward to firmly hold pencil lead elements (30) or slightly pulled open to let pencil lead elements (30) pass therethrough. By means of elastic property, the bottom hook end (13) of the elastic hook means (12) of the outer pen-holder (10) projects through the piercing groove (23) into the inner center of the inner cylinder (20) to stop pencil lead elements (30) from dropping. A plurality of wedge-like projections (28) are integrally and parallely made on the outer wall of the inner cylinder (20) and are respectively extending vertically upward in reduced size. When the inner cylinder (20) is pushed to the upper limit position to let the transversely projecting top end (21) be stopped by the flange (14) which is made on the inner wall surface of the outer pen-holder (10), the wedge-like projections (28) are compressed by the inner wall of the outer pen-holder (10) to let the bottom end of the inner cylinder (20) firmly hold the bottom piece of pencil lead element (30) for smooth writing.

Figure 5:
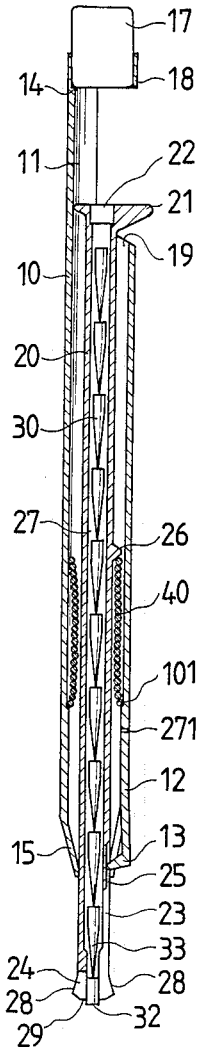
FIG. 5 is a sectional view of the first embodiment of the present invention, illustrating a bottom piece of pencil lead element in a broken condition.
Figure 6:
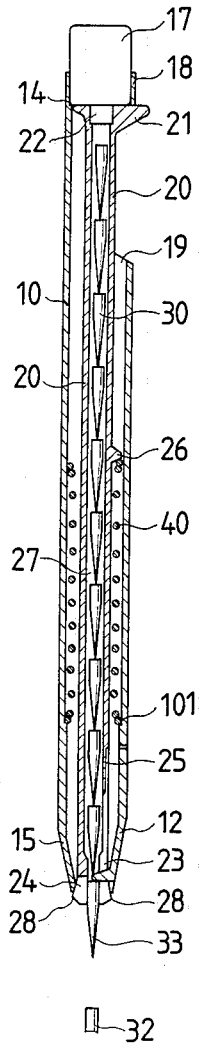
FIG. 6 is a sectional view of the first embodiment of the present invention, similar to FIG. 4, illustrating the inner cylinder pushed to the upper limit position by a compression spring, and the bottom piece of pencil lead element protruding beyond the apparatus for writing.
Figure 7:
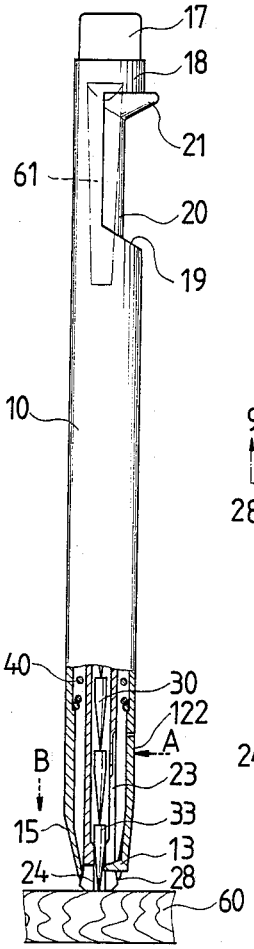
FIG. 7 is a sectional view of the first embodiment of the present invention, illustrating the bottom piece of pencil lead element pressed against a table surface to retreat back inside the inner cylinder.
Figure 8:
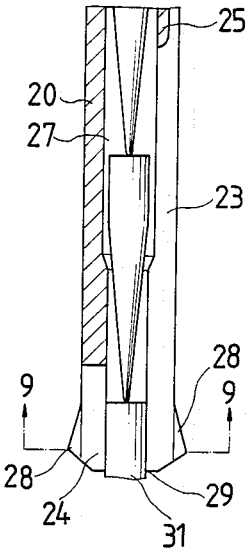
FIG. 8 is a fragmentary enlarged view taken in the same direction as FIG. 5.
Figure 9:
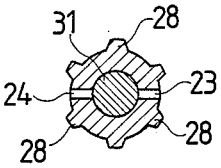
FIG. 9 is a cross sectional view taken on line 9—9 of FIG. 8.

Referring to FIGS. 3 and 4 again, when in operation, the transversely projecting top end (21) of the inner cylinder (20) is pushed down in the transverse opening (19), the semi-circular projection (26) comes in contact with the inner upper portion of the reduced front end (15) of the outer pen-holder (10), and the bottom hook end (13) of the hook means (12) is pushed aside by the inner cylinder (10) to further get into the upper shallow groove portion (25) of the piercing groove (23) where the hook means (12) is retained against breaking away from the longitudinal axis of the piercing groove (23). Although the pencil lead elements (30) are not stopped by the bottom hook end (13), the pencil lead elements (30) will not drop out of the writing apparatus because of the inward clamping force and the effect of the reduced bore of the lower end of the inner cylinder (20) where the piercing grooves (23) and (24) are made. As shown in FIG. 4, when the inner cylinder (20) is pushed upward, the pencil lead elements (30) will initially follow the inner cylinder (20) to move upward. As soon as the bottom hook end (13) of the hook means (12) is sliding along the shallow groove (25) into the gap between the bottom two pieces of pencil lead elements, the bottom piece of pencil lead element (31) becomes stopped by the hook end (13) to not follow the inner cylinder (20) to move upward. Therefore, when the inner cylinder (20) is continuously pushed upward to the upper limit to become stopped by the flange (14), the bottom piece of pencil lead element (31) is stopped by the hook end (13) and becomes partly protruding beyond the outlet (29) for writing. In case the protruding bottom piece of pencil lead element (31) is broken or becomes thick and not smooth for writing and has to be replaced by a next pencil lead element, it may be operated according to the above-said procedure, to press down the inner cylinder (20) (as indicated in FIG. 5). As soon as downward pressing force is released, the inner cylinder (20) will be immediately pushed to the upper limit by the compression spring (40) to let the hook end (13) of the hook means (12) fall into the inner side of the inner cylinder (20) (as shown in FIG. 6), and a new piece of pencil lead element (33) will be automatically pushed to partly protrude beyond the outlet (29) for writing. When not used, the press portion (122) (FIGS. 7 and 11) may be pressed in the direction of arrow a to move the hook end (13) outward from the inner cylinder 20, and then the protruding lead member (33) may be pressed against table surface (60) or opposed against a finger in the direction of arrow B and thereby retracted into the inner cylinder 20 for thereby protecting and conveniently carrying the lead member (33) (as shown in FIG. 7).

According to the present invention, the compression spring (40) is mounted on the inner cylinder (20) and set between the semi-circular projection (26) of the inner cylinder (20) and the inner bottom flange (101) of the outer pen-holder (10). In operation, the inner cylinder (20) is pressed down by a thumb on the transversely projecting top end (21) to compress the compression spring (40). As soon as the thumb is released from the transversely projecting top end (21), the spring force of the compression spring (40) will immediately push the inner cylinder upward to let the transversely projecting top end (21) be stopped at the neck-like retainer portion (11), and a new piece of pencil lead element will be concomitantly forced to protrude beyond the outlet (29) for writing.

Figure 10:
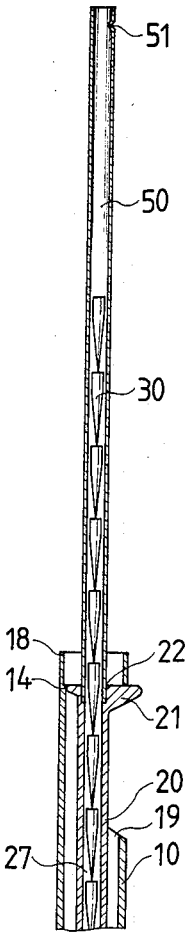
FIG. 10 is a sectional view of the first embodiment of the present invention, illustrating new pencil lead elements being refilled into the inner cylinder from a pencil lead reservoir.

Referring to FIG. 10, when the pencil lead elements in the inner cylinder (20) are to be used up, a pencil lead reservoir (50) which contains a row of pencil lead elements may be used to fill the supply through the top pencil lead filling inlet (22) of the inner cylinder (2). According to the present invention, the bore of the top pencil lead filling inlet (22) is slightly larger than the outer diameter of the pencil lead reservoir (50), such that the front end of the pencil lead reservoir (50) may be directly inserted into the top pencil lead filling inlet (22) to fill pencil lead elements into the inner cylinder (20) so as to facilitate filling of pencil lead elements and protect the hands against contamination. The pencil lead reservoir (50) is formed with a restricting flange (51) on inner wall adjacent to top end thereof the prevent the inner lead members (30) from dropping reversely.

Figure 12:
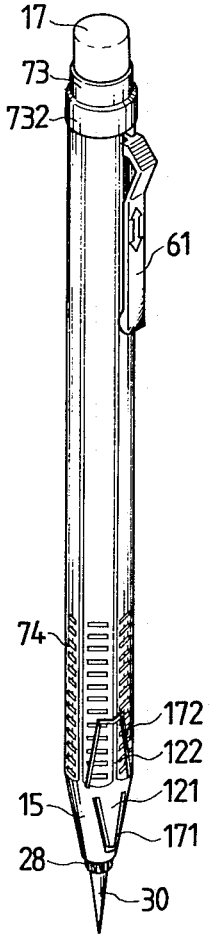
FIG. 12 is a perspective view of a second embodiment constructed according to the present invention.
Figure 13:
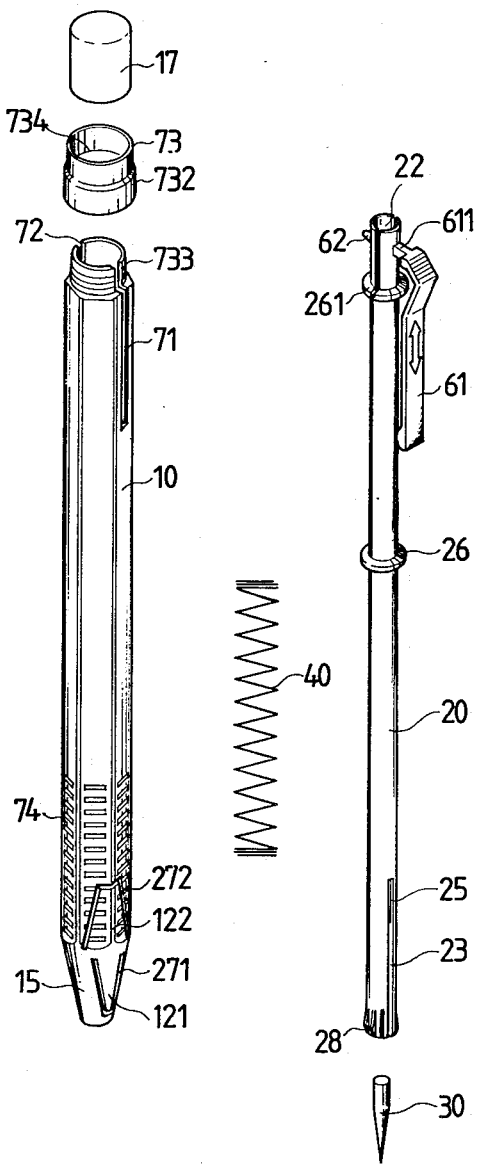
FIG. 13 is a perspective exploded view of the said second embodiment of the present invention.
Figure 14:
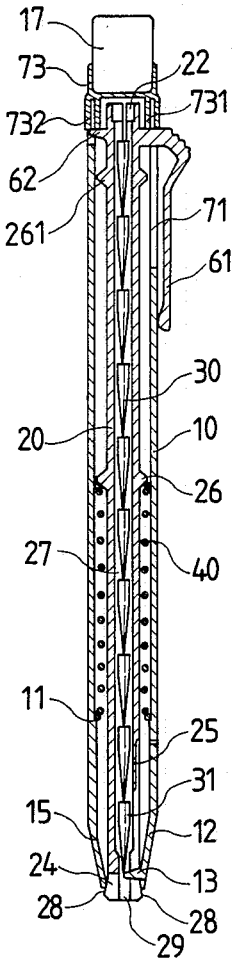
FIG. 14 is a sectional view of the said second embodiment of the present invention, illustrating the pencil lead elements stopped by the hook means.

Referring to FIGS. 12 through 14, there is shown another embodiment constructed according to the present invention and generally comprised of an outer pen-holder (10), and inner cylinder (20) and a compression spring (40). The outer pen-holder is a hollow tube for receiving therein the inner cylinder (20), and comprises integrally a reduced bottom end (15). A lower V-shaped slit (171) is made on the reduced front end (15) and an upper V-shaped slit (172) is invertedly made on the reduced front end (15) at the upper side against the lower V-shaped slit (171) to define therewith a suspended elastic hook means (12). The suspended hook means (12) is having a bottom hook end (13) turning inward to transversely insert into the inner center of the inner cylinder (20) and to stop the pencil lead elements (30) against dropping, wherein the hook end (13) of the suspended hook means (12) may be forced to move outward, through the effect of lever motion when the press portion (122) is pressed inward, to let pencil lead element (30) pass therethrough.

In this embodiment, the inner cylinder 20 defines a hollow chamber (27) suitable for receiving therein a row of pencil lead elements (30). A clip (61) is made on the top of the inner cylinder (20), which clip (61) may be arranged to slide along the elongated piercing groove (71) vertically made on the outer pen-holder at the top. The inner cylinder (20) is also integrally comprising a projecting end (62) oppositely disposed against the clip (61). When the inner cylinder (20) is received in the outer pen-holder (10), the projecting end (62) and the connection end (611) of the clip (61) are respectively set in the piercing grooves (71) and (72) of the outer pen-holder (10). A pen socket (73) which is mounted on the outer pen-holder (10) at the top is comprising an inner trough (734) for setting therein of an eraser (17), and a bottom flange (732) having internally a hollow cylinder (731) which has an inner diameter equal to the top end of the outer pen-holder (10). When the pen socket (73) is mounted on the outer pen-holder (10), the several parallely disposed ring portions (733), which are integrally made on the outer wall surface of the outer penholder (10) at the top, are set in between the bottom flange (732) and the inner hollow cylinder (731) to reinforce the engagement of the pen socket (73) with the outer pen-holder (10).

Figure 16:
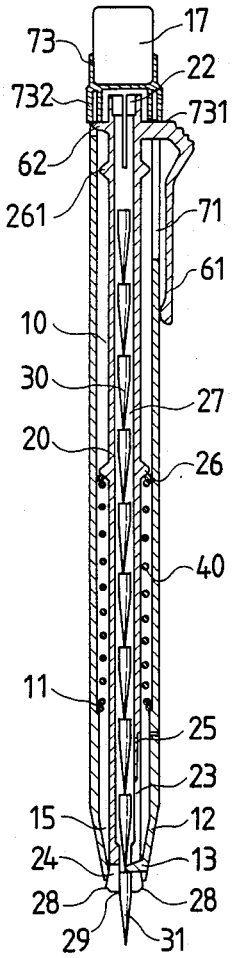
FIG. 16 is a sectional view of the said second embodiment of the present invention, illustrating the inner cylinder pushed by a compression spring to move to the upper limit position, and the bottom piece of pencil lead element protruding beyond the apparatus for writing.
Figure 19:
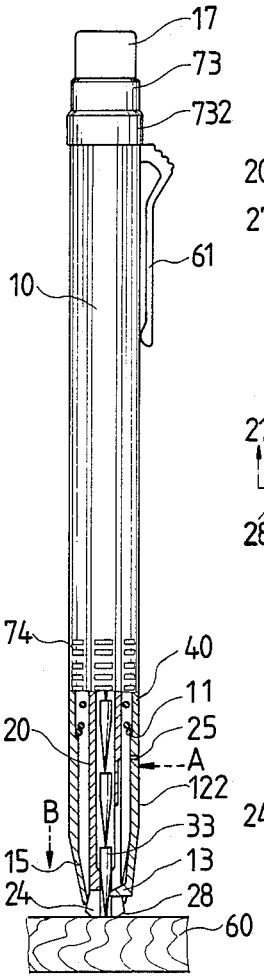
FIG. 19 is a sectional view of the said second embodiment, illustrating the bottom piece of pencil lead element pressed against a table surface to retreat back inside the inner cylinder.
Figure 20:
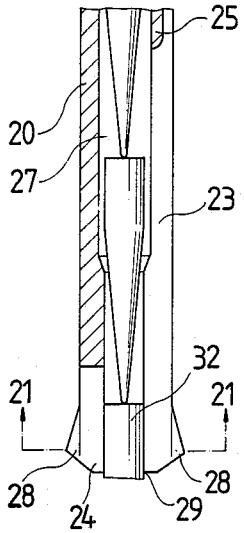
FIG. 20 is a fragmentary enlarged view taken in the same direction as FIG. 17.
Figure 21:
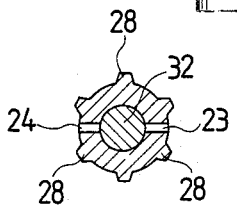
FIG. 21 is a cross sectional view taken on line 21—21 in FIG. 20.

Two piercing grooves (23) and (24) are oppositely made on the inner cylinder (20) and vertically extending upward from the bottom end to make the pencil lead outlet (29) elastic, such that the outlet (29), which is smaller than the outer diameter of pencil lead elements (30), may be slightly expanded outward to let pencil lead elements (30) pass therethrough. According to the present invention, the hook end (13) of the hook means (12) may be set into the inner center of the inner cylinder (20), through either one of the two piercing grooves (23) and (24), to stop the pencil lead elements (30) from dropping out of the outlet (29). A plurality of wedge-like projections (28) are integrally and parallely made on the outer wall of the inner cylinder (20) and are extending vertically upward in reduced size. When the inner cylinder (20) is pushed upward to the upper limit, the wedge-like projections (28) will be compressed by the inner wall of the outer pen-holder (10) to firmly hold the bottom piece of pencil lead element (30) for smooth writing (as shown in FIGS. 16 and 19). Two ring portions (26) and (261) which are having an outer diameter slightly smaller than the inner diameter of the outer penholder (10) are respectively made on the inner cylinder (20) at the upper and the middle part to stabilize the inner cylinder (10) when the inner cylinder (20) is sliding inside the outer pen-holder (10). According to the present invention, the compression spring (40) is mounted on the inner cylinder (20) and set between the lower ring portion (26) and a stop flange (11) which is made on the inner wall surface of the outer pen-holder (10). Therefore, when a pressing force is released from the inner cylinder (20) after the inner cylinder is pressed down, the inner cylinder (20) will be immediately pushed to the upper limit position by the spring force of the compression spring (40).

Figure 15:
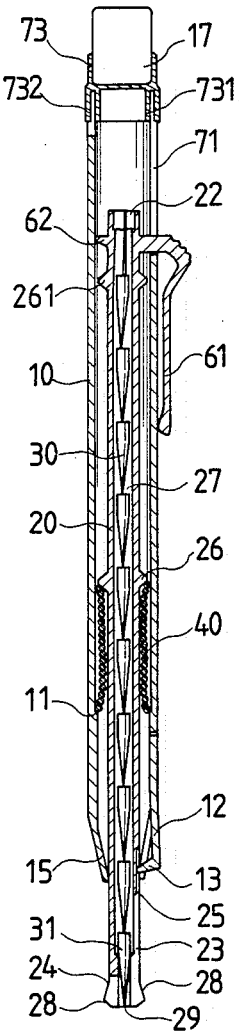
FIG. 15 is a sectional view of the said second embodiment of the present invention, illustrating the inner cylinder pressed down.

Referring to FIGS. 14 through 16, when in use, the clip (16) is pressed to carry the inner cylinder (20) to move downward so as to push the hook end (13) of the hook means (12) aside. The hook end (13) of the hook means (12) will then move into the shadow groove (25) at the upper end of the piercing groove (23) to protect the hook means (12) against breaking away from the central line of the longitudinal axis of the piercing groove (23). When the clip (61) is released after it is pushed downward to the lower limit of the piercing groove (71), the spring force of the compression spring (40) will immediately push the inner cylinder (20) upward to permit the hook end (13) of the hook means (12) slide along the shallow groove (25) to further insert into the inner side of the inner cylinder (20) and become disposed at the top surface of the bottom piece of pencil lead element (31). Because the bottom piece of pencil lead element (31) is stopped by the hook end (13) of the hook means (12), the pencil lead element (31) will be forced to partly protrude beyond the pencil lead outlet (29) after the projecting end (62) is inserted into the piercing groove (72).

Figure 17:
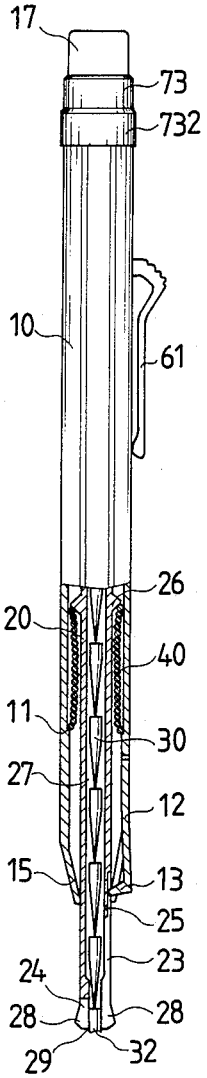
FIG. 17 is a sectional view of the said second embodiment of the present invention, illustrating a bottom piece of pencil lead element in a broken condition
Figure 18:
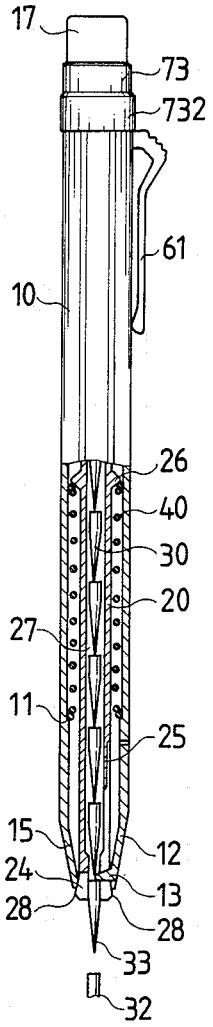
FIG. 18 is a sectional view of the said second embodiment of the present invention, illustrating that the broken piece of pencil lead element has been replaced by a new piece of pencil lead element.

Referring to FIGS. 17 and 18, in case the bottom piece of pencil lead element (32) is broken or becomes thick and not smooth for writing and has to be replaced by a next pencil lead element, it may be operated according to the above-said procedure, to press down the clip (61) to the lower limit. As soon as downward pressing force is released from the clip (61), the inner cylinder (20) will be immediately pushed to the upper limit by the compression spring (40) to let a new piece of pencil lead element (33) be automatically pushed to partly protrude beyond the outlet (29) for writing. To retract the pencil lead element (33) inside the writing apparatus after use, the press portion (122) is pressed in the direction of arrow a inward to displace the hook end (13) outward, and then the protruding bottom piece of pencil lead element (33) is vertically pressed against a table surface (60) or a fingertip in the direction of arrow Bpermitting the endmost pencil element, to be retreated back into the inner cylinder (20) for convenient carriage (as shown in FIG. 19).

Figure 22:
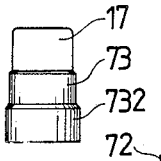
FIG. 22 is a fragmentary sectional view of the said second embodiment of the present invention, illustrating new pieces of pencil lead elements being refilled into the inner cylinder from a pencil lead reservoir.
Figure 22:
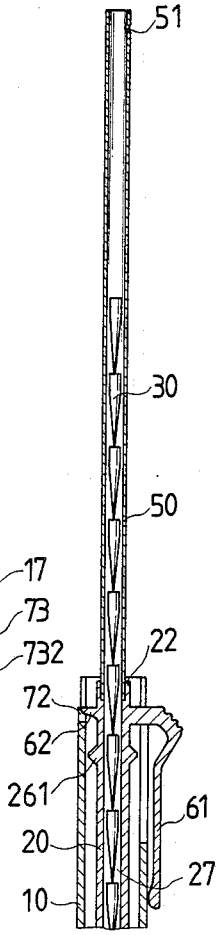

Referring to FIG. 22, when the pencil lead elements in the inner cylinder (20) are used up, a pencil lead reservoir (50) which contains a row of pencil lead elements may be used to fill the supply through the top inlet (22) of the inner cylinder (20). According to the present invention, the bore of the top pencil lead filling inlet (22) is slightly larger than the outer diameter of the pencil lead reservoir (50), such that the front end of the pencil lead reservoir (50) may be directly inserted into the top inlet (22) to fill new pencil lead elements into the inner cylinder (20) so as to facilitate filling of pencil lead elements, prevent from dropping of pencil lead elements during filling process, and protect the hands against contamination.

As indicated, the structure herein may be variously embodied. Recognizing various modifications will be apparent, the scope hereof shall be deemed to be defined by the claims as set forth below.

What is claimed is:

1. A writing implement comprising an elongated annular outer casing (10), an inner tube (20) slidably mounted within said outer casing, and a plurality of sharpened writing elements (30) stacked in axial alignment within said tube;

said outer casing comprising an elongated annular member having first and second end sections; said first end section being configured as a tapered frusto-conical wall section (15); a first essentially V-shaped slit (271) extending through said tapered wall section to form an axially elongated resilient leg (12) integral with the tapered wall section; said resilient leg having a cantelever connection with the associated wall section, a free end spaced a short distance axially from the end edge of the tapered wall section, and a hook section (13) extending generally radially inwardly from the free end of said leg (12), said hook section being integral with the leg;

said first resilient leg having a normal unstressed position wherein its outer side surface lies in the outer surface plane of the tapered wall section; said resilient leg having a stressed position wherein its outer side surface projects outwardly beyond the outer surface plane of the tapered wall section;

said outer casing having a second essentially V-shaped slit (271) spaced axially from said first V-shaped slit to define a second resilient leg; the apex portions of the two Vs facing in opposite directions, with the wall areas circumscribed by the two V-shaped slits being integrally connected, such that inward manual pressure on the second leg produces an outward deflection of the first leg from its normal unstressed position;

said tube having a radially enlarged element gripper end section (28) adapted to move between a retracted position extending a relatively short distance out of the tapered wall section, and an extended position projecting a relatively great distance beyond said tapered wall section; two diammetrically spaced slots (23 and 24) formed in said tube end section so that said end section forms a gripper mechanism for the writing elements;

said tube being oriented within said casing so that the hook section of the first leg normally extends into the second slot when said gripper end section is in its retracted position whereby said hook section is then located between the projecting writing element and the remaining writing elements within the tube.

2. The writing implement of claim 1, wherein the axial spacing between the two V-shaped slits is substantially less than the length of each V.

3. The writing implement of claim 1, wherein said second V-shaped slit is located in a cylindrical portion of the outer casing.

4. The writing implement of claim 1, and further comprising a groove (71) formed in said second end section of the outer casing; and manually-actuable arm (61) extending from said inner tube through said groove and along the casing outer surface, whereby axial thumb pressure on said arm can be used to move the inner tube.

5. The writing implement of claim 4, and further comprising a second axial groove (72) formed in said second end section of the outer casing in diammetrically spaced relation to said first mentioned groove; and an eraser-reception socket means (73) removably encircling the second end section of the outer casing to overlie the two grooves.

* * * * *